US006148485A

United States Patent [19]

Wu

[11] Patent Number: 6,148,485

[45] Date of Patent: Nov. 21, 2000

[54] STRUCTURE OF A BUCKLE FOR A BELT

[76] Inventor: Chuan-Lin Wu, P.O. Box 82-144, Taipei, Taiwan

[21] Appl. No.: 09/208,468

[22] Filed: Dec. 2, 1998

[51] Int. Cl.[7] ..... A44B 11/25

[52] U.S. Cl. ..... 24/163 R; 24/170; 24/191

[58] Field of Search ..... 24/163 R, 265 WS, 24/265 BC, 265 EC, 310, 34, 316, 330, 331, 332, 585, 633, 636, 685 K, 68 E, 168, 170, 171, 178, 179, 188, 191

[56] References Cited

U.S. PATENT DOCUMENTS

| | | | |
|---|---|---|---|
| 3,434,186 | 3/1969 | Reenert | 24/191 |
| 4,669,155 | 6/1987 | Chen | 24/170 |
| 5,588,184 | 12/1996 | Chen | 24/170 |
| 5,588,186 | 12/1996 | Ko | 24/585 |
| 5,673,463 | 10/1997 | Chih-wen | 24/265 BC |
| 5,806,145 | 9/1998 | Chen | 24/170 |
| 5,839,170 | 11/1998 | Cho | 24/163 R |
| 5,870,803 | 2/1999 | Jorst | 24/265 WS |

*Primary Examiner*—Robert J. Sandy
*Attorney, Agent, or Firm*—A & J

[57] ABSTRACT

A buckle for a belt includes a frame having two opposite sides formed with two upwardly extending lugs each having a through hole, two arms each extending outwardly from a respective one of the lugs, and a shoulder bridging another sides of the lugs, and a retainer generally including a tubular member, a shaft, and a spring, the tubular member having an elongated opening having an edge formed at an intermediate portion thereof with a hook, each end of the tubular member having a longitudinally and outwardly extending rod member, another edge of the elongated opening having a radial groove close to an end of the tubular member, an L-shaped handle close to the radial groove, the shaft extending longitudinally through both ends of the retainer and supported by the lugs at two ends thereof, the shaft having an intermediate portion formed with a through hole, the spring having a first end engaged with the through hole of the shaft and a second end fitted in the groove, whereby the belt can be easily fastened and released as desired.

1 Claim, 6 Drawing Sheets

STRUCTURE OF A BUCKLE FOR A BELT

BACKGROUND OF THE INVENTION

1. Field of the Invention

This invention is related to an improvement in the structure of a buckle for a belt.

2. Description of the Prior Art

As shown in FIG. 1, the conventional buckle 1 for a belt is provided with two lugs 11 at two opposite sides on which is pivotally mounted a fixing member 12 having a hook for keeping the position of the belt. However, such a buckle 1 is inconvenient to use and has to be improved in structure.

Therefore, it is an object of the present invention to provide an improved buckle for a belt which can obviate and mitigate the above-mentioned drawbacks.

SUMMARY OF THE INVENTION

This invention is related to an improvement in the structure of a buckle for a belt and in particular to one including a frame having two opposite sides formed with two upwardly extending lugs each having a through hole, two arms each extending outwardly from a respective one of the lugs, and a shoulder bridging another sides of the lugs, and a retainer generally including a tubular member, a shaft, and a spring, the tubular member having an elongated opening having an edge formed at an intermediate portion thereof with a hook, each end of the tubular member having a longitudinally and outwardly extending rod member, another edge of the elongated opening having a radial groove close to an end of the tubular member, an L-shaped handle close to the radial groove, the shaft extending longitudinally through both ends of the retainer and supported by the lugs at two ends thereof, the shaft having an intermediate portion formed with a through hole, the spring having a first end engaged with the through hole of the shaft and a second end fitted in the groove.

It is the primary object of the present invention to provide a buckle which enables a belt to be rapidly fastened or released as desired.

It is another object of the present invention to provide a buckle which can be engaged with a belt without punch holes.

It is still another object of the present invention to provide a buckle for a belt which is simple in construction.

It is still another object of the present invention to provide a buckle for a belt which is easy to use.

It is a further object of the present invention to provide a buckle for a belt which is fit for practical use.

DETAILED DESCRIPTION OF THE PREFERRED EMBODIMENT

Figure 1:
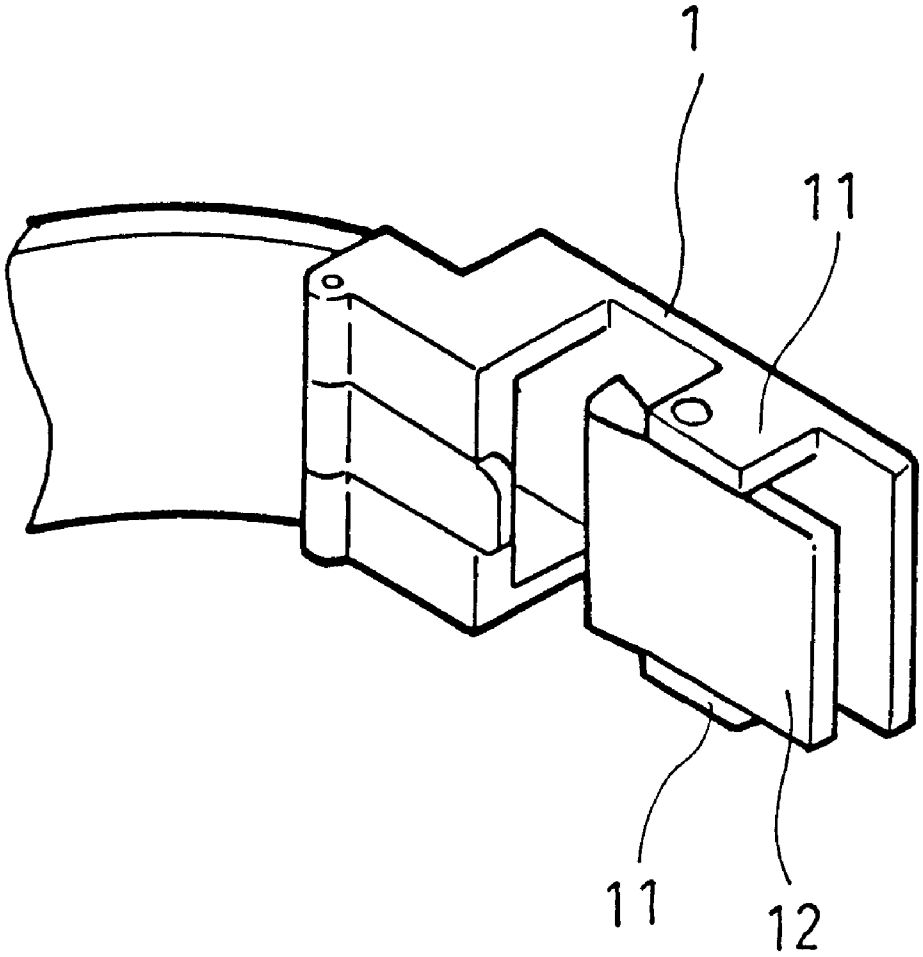
PRIOR ART FIG. 1
FIG. 1 is a perspective view of a prior art buckle for belts.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
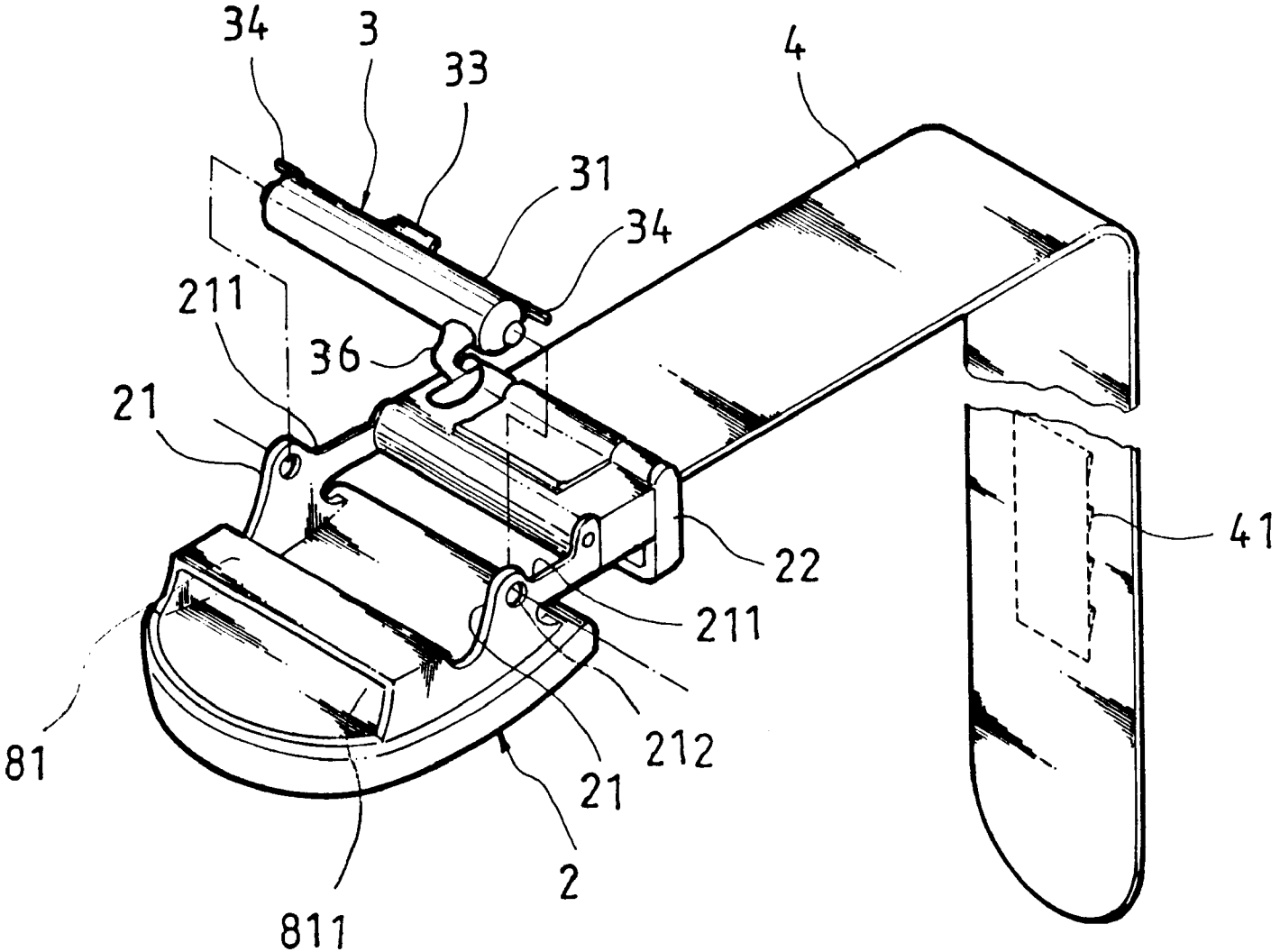
FIG. 2 is an exploded view of a buckle for belts according to the present invention.
Figure 3:
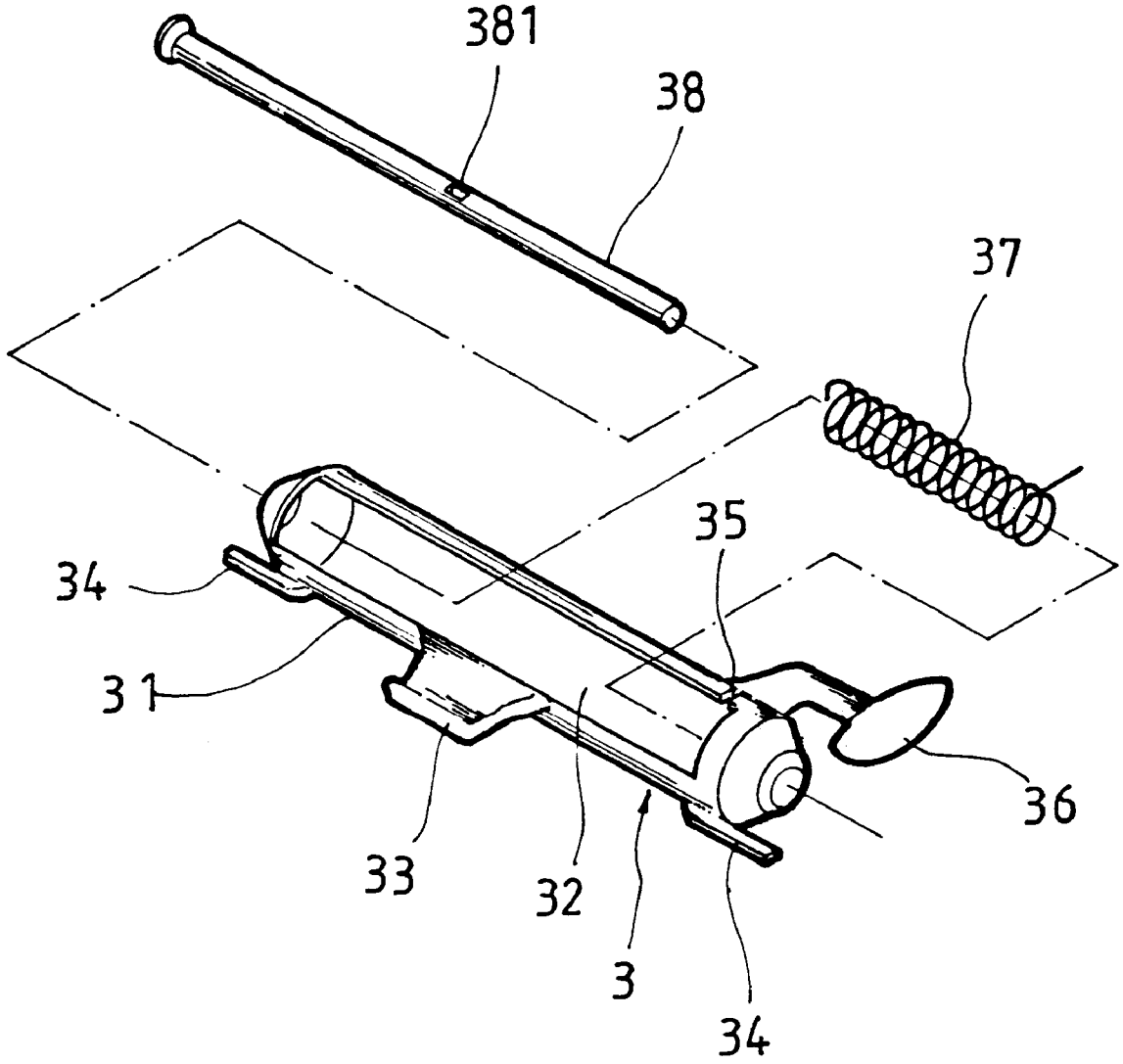
FIG. 3 is an exploded view of the retainer.

With reference to the drawings and in particular to FIGS. 2 and 3 thereof, the buckle according to the present invention generally comprises a frame 2 and a retainer 3.

The frame 2 is formed with two upwardly extending lugs 21 at two opposite sides thereof for receiving the retainer 3 therebetween. Each of the lugs 21 has a through hole 212. An arm 211 extends outwardly from each of the lugs 21. A shoulder 81 is provided for bridging the other sides of the lugs 21. The shoulder 81 has a distance from the bottom of the frame 2 thereby forming a passage 811.

Figure 6:
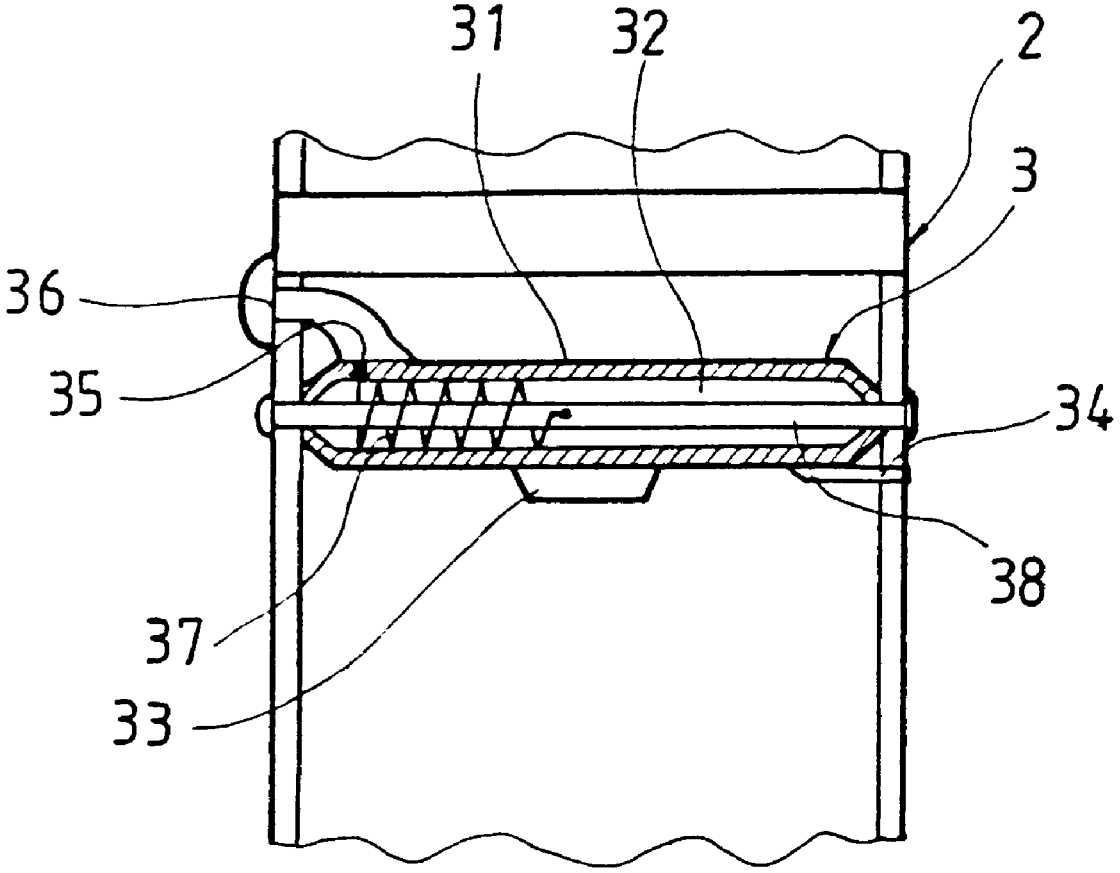
FIG. 6 is a sectional view illustrating engagement between the retainer and the frame.

The retainer 3 generally comprises a tubular member 31, a shaft 38, and a spring 37. The tubular member 31 has an elongated opening 32 having an edge formed at the intermediate portion with a hook 33. Both ends of the tubular member 31 has a longitudinally and outwardly extending rod member 34. The other edge of the elongated opening 32 is formed with a radial groove 35 close to an end of the tubular member 31. The tubular member 31 has an L-shaped handle 36 close to the radial groove 35. The shaft 38 extends longitudinally through both ends of the retainer 3 and engages with the through holes 212 of the lugs 21 of the frame 2 at two ends. In addition, the shaft 38 has a through hole 381 at the intermediate portion thereof so that the tubular member 31 can be rotated with respect to the shaft 38. The spring 37 has a first end engaged with the through hole 381 of the shaft 38 and a second end fitted in the groove 35 (see FIG. 6).

A fixed member 22 is secured to the arms 211 of the frame 2 for fixing an end of a belt 41. The fixed member 22 may be of any conventional design well known to the art and is not considered a part of the present invention. The other end of the belt 41 is formed with a plurality of serrations 41 so that when said other end of the belt 41 is inserted through the passage 811 of the frame 2, the serrations 41 engageable with the hook 33 of the retainer 3.

Figure 4:
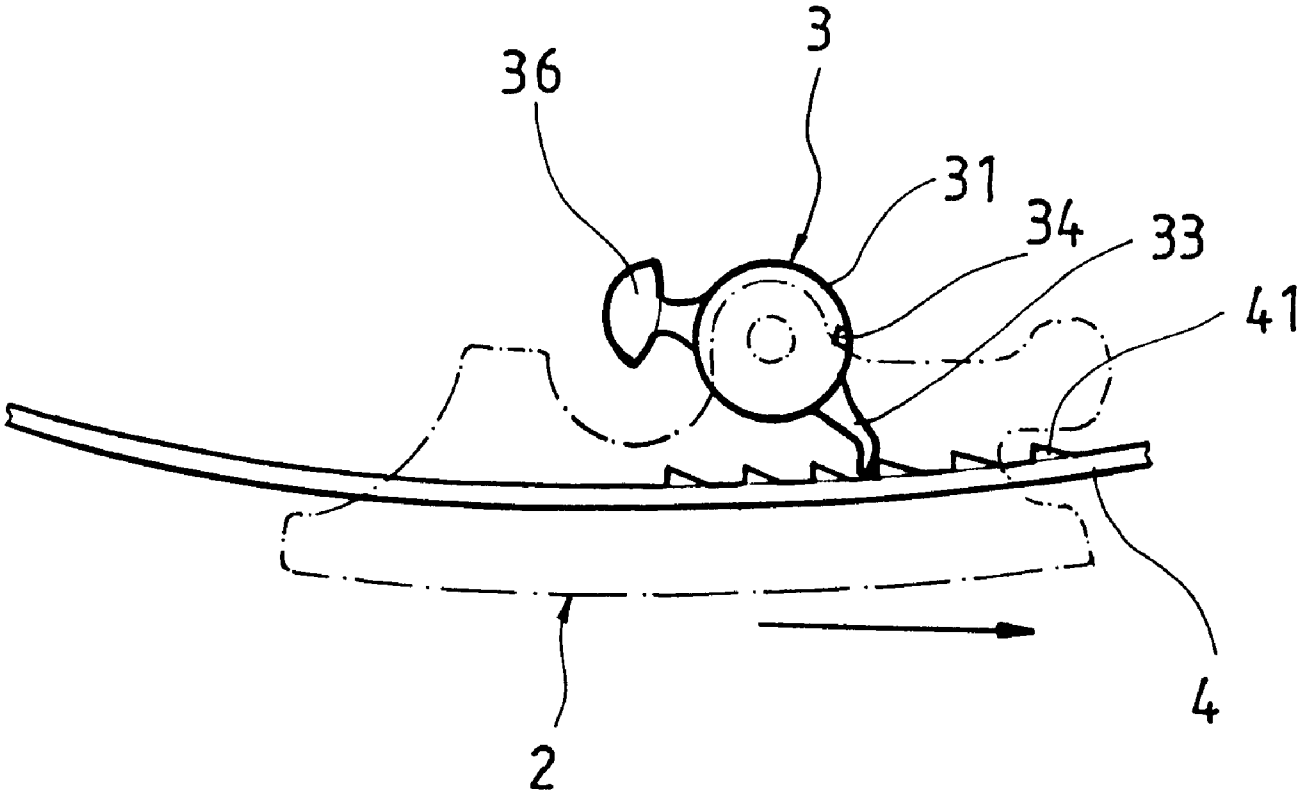
FIGS. 4 and 5 are working views of the present invention.

Referring to FIG. 4, the end of the belt 4 provided with serrations 41 may slide under the tubular member 31. However, as the spring 37 tends to force the hook 33 to move toward the bottom of the frame 2, the belt 4 may slide under the tubular member 31 in one direction only. When a desired length of the belt 4 has passed through the frame 2, it is only necessary to slightly pull the belt 4 to move in an opposite direction thereby firmly engaging the serrations 41 with the hook 33 and therefore keeping the belt 4 at a desired position.

Figure 5:
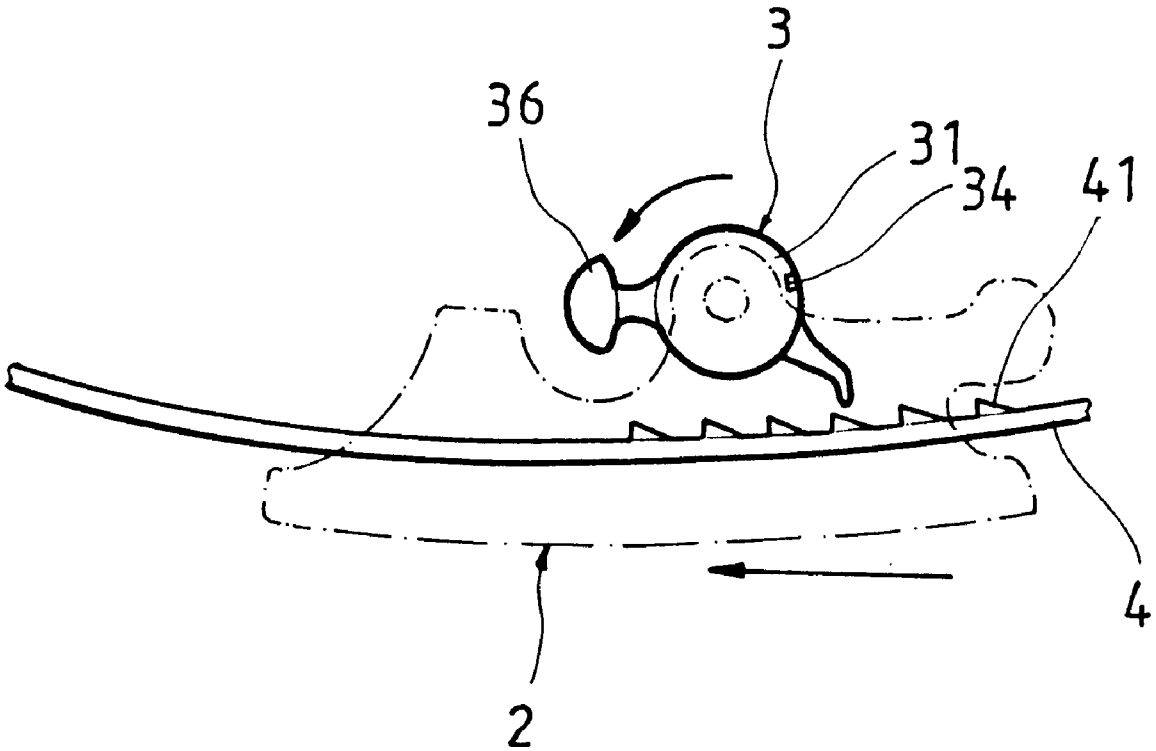

Referring to FIG. 5, when desired to release the belt 4, it is only necessary to depress the handle 36 to lift the hook 33 thus disengaging the hook 33 from the serrations 41 of the belt 4.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A buckle for a belt, comprising:

a frame having two opposite sides formed with two upwardly extending lugs each having a through hole, two arms each extending outwardly from a respective one of said lugs, and a shoulder bridging another sides of said lugs, said shoulder having a distance from a bottom of said frame; and a retainer including a tubular member, a shaft, and a spring, said tubular member having an elongated opening having an edge formed at an intermediate portion thereof with a hook, each end of said tubular member having a longitudinally and outwardly extending rod member, another edge of said elongated opening having a radial groove close to an end of said tubular member, an L-shaped handle close to said radial groove, said shaft extending longitudinally through both ends of said retainer and supported by said lugs at two ends thereof, said shaft having an intermediate portion formed with a through hole, said spring having a first end engaged with said through hole of said shaft and a second end fitted in said groove.

* * * * *